United States Patent [19]

Siryj

[11] 4,148,575

[45] Apr. 10, 1979

[54] THERMAL PROCESSOR

[75] Inventor: Bohdan W. Siryj, Cinnaminson, N.J.

[73] Assignee: RCA Corporation, New York, N.Y.

[21] Appl. No.: 818,010

[22] Filed: Jul. 22, 1977

[51] Int. Cl.[2] ..... G03D 7/00

[52] U.S. Cl. ..... 354/299; 354/300; 219/216; 219/388; 34/155

[58] Field of Search ..... 354/297, 299, 300, 317, 354/339; 34/155, 160; 219/216, 388, 381

[56] References Cited

U.S. PATENT DOCUMENTS

| | | | |
|---|---|---|---|
| 3,311,525 | 3/1967 | Fanuzzi et al. | 219/381 |
| 3,496,332 | 2/1970 | Lunde | 219/216 |
| 3,585,917 | 6/1971 | Griffith | 354/297 |
| 3,727,534 | 4/1973 | Low et al. | 354/300 |
| 3,826,896 | 7/1974 | Thompson | 219/216 |
| 4,052,732 | 10/1977 | Meadows | 354/297 |

*Primary Examiner*—L. T. Hix
*Assistant Examiner*—Alan Mathews
*Attorney, Agent, or Firm*—H. Christoffersen; Samuel Cohen; William Squire

[57] ABSTRACT

The length of film being developed by heat is supported on a fluid bearing by heated air which passes through two porous elements which serve as the walls of the film passageway. The air is preheated and the porous elements themselves are separately heated in order further to raise the temperature of the air bearing.

10 Claims, 6 Drawing Figures

THERMAL PROCESSOR

Figure 1:
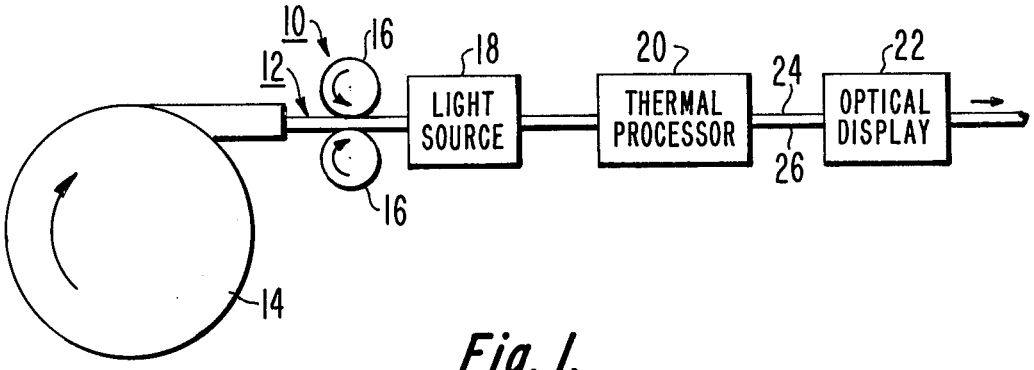

Of interest are the following copending U.S. applications, both assigned to the same assignee as the present application. (a) Ser. No. 790,196, entitled "THERMAL PROCESSOR IN AN APPARATUS FOR DEVELOPING PHOTOGRAPHIC FILM", filed on or about Apr. 25, 1977, by Bohdan Wolodymr Siryj, Richard David Scott and Charles R. Horton (b) Ser. No. 790,662, entitled, "APPARATUS FOR DEVELOPING PHOTOGRAPHIC IMAGES ON AN EMULSION COATED FILM", filed Apr. 25, 1977 by Richard David Scott.

This invention relates to a heating apparatus for supplying gas at an elevated temperature at a uniform pressure.

The present invention is particularly useful in a thermal processor for gas heat development of a photographic image on a strip of photographic film which passes through the processor. The thermal processor heats the film and supports the film by a controlled flow of gas. This type of system is described in more detail in the aforementioned copending applications. Briefly, the present system when used in a thermal processor for developing photographic film, is a system in which dry development of photographic images on sensitized film is achieved by thermal processing subsequent to exposure of the sensitized surface to light.

Particular apparatus for achieving thermal processing and heat development with a dry silver emulsion is described in further detail in copending application (a) above. In these processors the gas may be heated in a remote chamber and then supplied to the gas porous distribution means via gas conduits or may be heated by elements next to the distribution means. These processes may result in uneven heating of the gas distribution means by reason of the thermal losses which may result in the transferring of the gas from the heater to the distribution means in the former case or due to localized temperature variations in the latter instance. The gas distribution means is described in the copending applications as a porous material such as graphite or ceramic.

A gas heating apparatus embodying the invention comprises a thermally conductive gas distribution means formed of a porous homogeneus material for uniformly distributing the gas through the pores of the material at a given pressure. Housing means support the gas distribution means and are arranged to receive the gas under pressure and to supply pressurized gas to the distribution means. Heater means are mounted thermally conductively to the distribution means for directly heating the distribution means and the gas passing through the porous material. The heater means includes gas passage means for passing the gas to the distribution means:

In the drawing.

Figure 2:
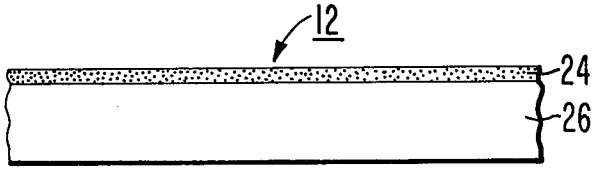
Figure 3:
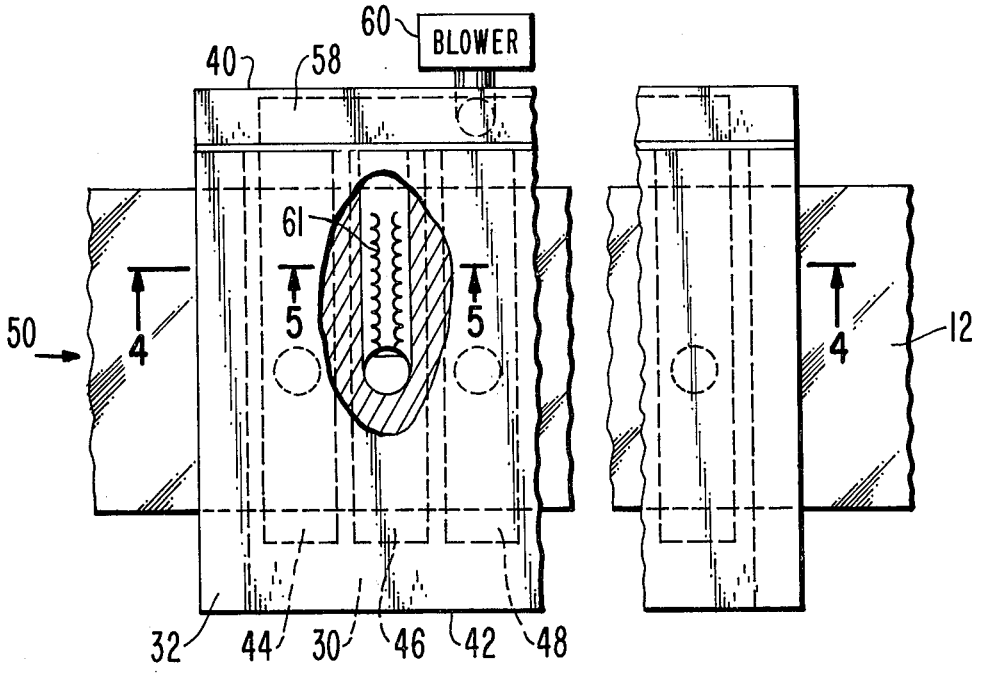

FIG. 1 is a schematic diagram of a photographic film developing apparatus embodying the present invention, FIG. 2 is fragmentary side elevation view of a photographic film utilized in the apparatus of FIG. 1, FIG. 3 is a fragmentary partially-sectioned plan view of the thermal processor embodying the present invention.

Figure 4:
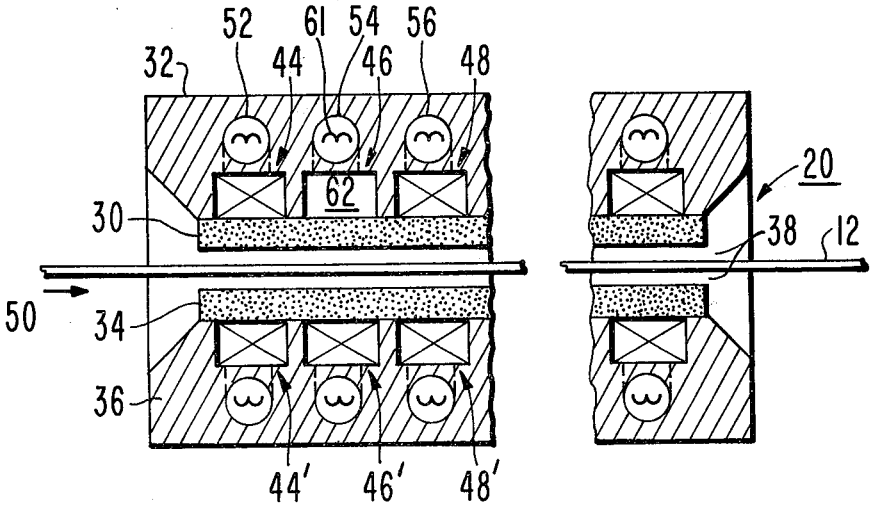
Figure 5:
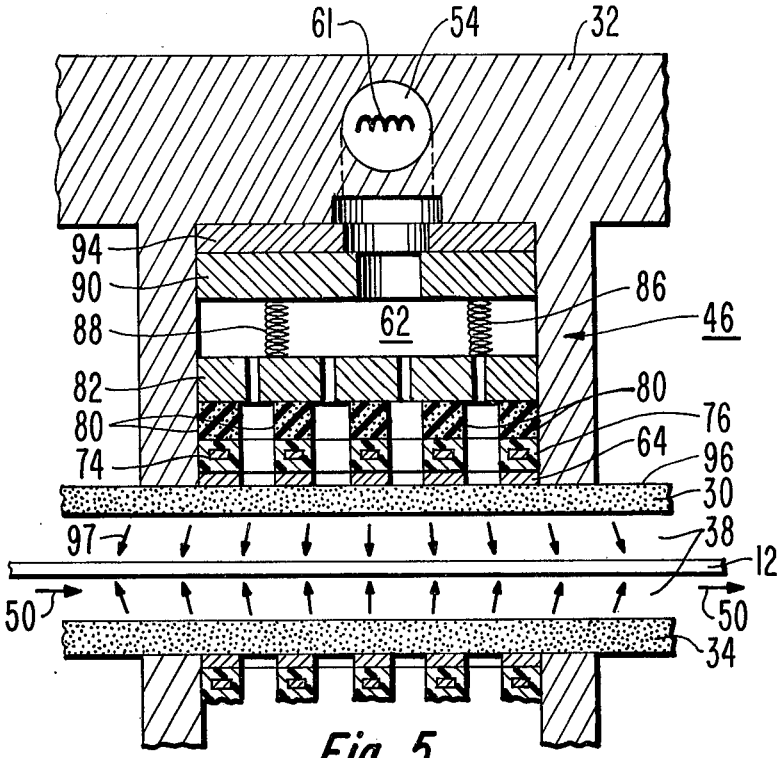
Figure 6:
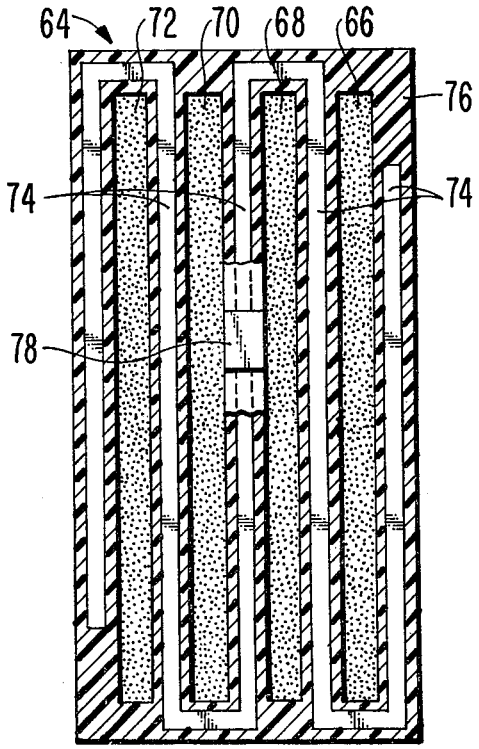

FIG. 4 is a sectional side elevational view of the apparatus of FIG. 3 taken along the lines 4—4, FIG. 5 is a sectional elevational view taken along lines 5—5 of FIG. 3, and FIG. 6 is a plan view of a heater element and heat transfer plate incorporated in the embodiment of FIGS. 3, 4 and 5.

In FIG. 1, photographic film 12 is fed from a supply cassette 14 into a film development apparatus 10 such as described in the above-identified application, (b). Film 12 passes through a pair of drive rollers 16 which convey film 12 through apparatus 10. Film 12, photothermally sensitized, as will be described subsequently, passes through a light source 18, preferably a confined laser beam. During the exposure to light from source 18, a latent image is recorded on film 12. The exposed film then passes through a suitable heat source, thermal processor 20, to develop a fixed photographic negative image which may be visually displayed on an optical display 22. By changing the electronic logic of the laser beam recorder, a positive image may alternatively be developed. The thermal processor now to be described in detail, may be used in any photographic system which utilizes heat-processing for image development and which does not require application of external liquid developing agents.

The photographic film 12, shown in FIG. 2, comprises a layer 24 of light sensitive and heat developable emulsion coated on a suitable base 26. Emulsion 24 may be a dry silver material comprising an oxidizing agent, such as a heavy metal salt, a reducing agent and a photosensitive component, such as photosensitive silver halide which serves as a catalyst for oxidation-reduction image forming combinations. A useful photosensitive material comprises, for example, an oxidation-reduction image forming combination comprising (i) silver behenate and/or silver stearate with (ii) a reducing agent, such as a bis-beta-naphthol and photosensitive silver halide. Other suitable image producing emulsions may be used instead.

Emulsion 24 can be coated on a base 26 of a wide variety of materials according to usual practice. Typical base materials for photographic film include glass, metal, paper cellulose, triacetate, polyethelene terephthalate and film bases having high heat distortion temperatures suitable for providing a film support for heat-fixing image development.

In FIGS. 3 and 4, planar porous member 30 and 34 are mounted to housings 32 and 36, respectively, the film 12 passing through a gap 38 between these members. The porous members 30 and 34 comprise sheets of homogeneous porous material, preferably graphite or ceramic material. Member 30 and housing 32 are mirror images of member 34 and housing 36. Housing 32 and 36 may be separate units or may be a complete assembly connected at ends 40 and 42. As shown in FIG. 4, the housings 32 and 36 are joined at ends 40 and 42 as an integral unit. The housing 32 contains a plurality of heating modules 44, 46, 48 and so forth. Each of the heating modules 44–48 is mounted on porous member 30 and each of the heating modules 44'–48' is mounted in complementary fashion to member 34.

A typical module 46 will be described in connection with FIGS. 5 and 6. The remaining modules are identical to module 46. Any number of modules may be mounted in housing 32 extending along the length of the path of the film 12 which travels in the direction 50. Film 12 is uniformly spaced from the members 30 and 34 with the emulsion side facing one of the members, for example, member 30.

Each of the modules 44, 46 and 48 and so on is connected in gas communication with its corresponding inlet duct 52, 54, 56 and so forth. Pressurized air is provided inlet ducts 52, 54, 56 via distribution cap 58 from blower 60. Cap 58 is a hollow housing in gas communication with each of the inlet ducts 52–56. Mounted in each of the ducts 52, 54, 56 and so forth are corresponding heaters 61 which are electrically connected for preheating air supplied to the ducts. Blower 60 provides pressurized air to each of modules 44, 46 and 48 via the ducts.

The air is supplied via the modules 44, 46, and 48 under pressure to the porous member 30. Member 30 is uniformily heated by the modules 44–48 as will be explained. The preheated air passing through the pores of the member 30 becomes additively heated by the member 30 to a sufficiently high temperature to develop the latent image on film 12. The air provided by blower 60 is pressurized so that film 12 is supported by the flow of the air passing through the pores of members 30 and 34. This forms a gas bearing for the film such that the film does not directly contact either the members 30 or 34 as it travels in direction 50.

Module 46 shown in FIG. 5 includes a chamber 62 which is rectangular in cross-section and extends along the width of housing 32. Chamber 62 is in gas communication with duct 54 by centrally vertically disposed duct. Chamber 62 is in gas communication with the porous member 30. Mounted in thermal conductive contact with the porous member 30 is slotted heat transfer plate 64.

Plate 64, FIG. 6, is made of highly thermally conductive material such as copper, having a thickness preferably of less than 1/32 inch. The slots 66, 68, 70 and 72 extend the length of the plate, permit air to flow from chamber 62 to porous member 30. The thickness of plate 64 and the spacing of the slots 66–72 is such that the plate 64 is sufficiently flexible to mount in fairly intimate thermal contact with the surface of member 30 even if the member 30 is not perfectly plane and smooth. If member 64 were stiff, slight imperfections in the surface of member 30 ordinarily would result in contact between plate 64 and member 30 only at certain high spots.

The plate 64 being sufficiently flexible, bends under pressure, as will be explained, contacting the member 30 along the length of each of the connecting strips 74. Heater 76 is in thermal contact with the upper surface of plate 64. Heater 76 may be a heating wire formed in a thin thermoplastic foil member. Openings such as slots are formed in the heater 76 directly above the slots 66–72 of plate 64 to permit air to pass through to the member 30. Mounted above the heating element 76 and centrally located on a strip 74 is a thermister 78 for providing suitable temperature control of the plate 64.

Slotted resilient member 80 made of sponge rubber or other resilient material is mounted above and in contact with the heater 76 to squeeze the heater and the plate 64 against member 30. Pressure plate 82 is disposed directly above the member 80 for applying resilient pressure to the plate 64 via compression springs 86 and 88. The plate 82 is apertured to permit air under pressure to pass through the member 80 slots and between the stips 74 into the porous material 30. Pressure plate 90 is mounted above the corresponding springs 88 and 86, respectively. Pressure plate 94 is mounted between the plate 90 and the housing 32 at the upper surface of the chamber 62.

All of the elements except the pressure plate 94 are inserted into the chamber 62 first. Pressure plate 94 is inserted last to prevent sliding contact of the plate 64 with porous member 30. Any sliding contact between the plates 64 and porous member 30 may result in dust being generated which could interfere with uniform heat transfer between porous member 30 and the plate 64. Such interference is highly undesirable. Then springs 86 and 88 are compressed and the pressure plate 94 inserted into chamber 62 to provide the desired pressure against plate 64.

Springs 86 and 88 provide uniform pressure to the rubber members 80 which in turn apply direct pressure against the heater 76 and in turn against strips 74 of plate 64. Thus, any unevenness of the upper surface 96 member 30 will be followed by the flexible plate 64.

Each of the modules 44, 46 and so on extending along the length of gap 38 is individually thermally controllable for applying heat to the air at that respective module. That is, each of the heaters 76 in each module has a separate control (not shown) for turning that heater on or off independent of the on or off state of the next adjacent module. However, the mirror image modules, for example, module 44', FIG. 4, associated with module 44, module 46' associated with module 46, and module 48' associated with module 48 are operated together as a pair and are either on or off as a pair. The rubber member 80 acts as a leveler and ensures uniform pressure between the heat transfer plate 64 and the porous member 30. The thermister 78 is in direct contact with the foil heater element 76 thus assuring that the thermal response time is well within the bandwidth of the temperature controller (not shown). Bandwidth is defined as that temperature range at the temperature sensor causing the controller to change the average power in the heater from 0 to 100%. The controller (not shown) turns on and off the heater 76 in selected ones of the modules 44–48. The number of pairs of modules in operation determines the time duration the film is heated as it passes through the module sets. The processing temperature is determined by the film characteristics and film speed. Thus, a wide variety of films may be handled by a single thermal processor 20.

In operation, the blower 60 supplies pressurized air to the cap 58 which supplies pressurized air to each of the ducts 52, 54, 56 and so forth. Pressurized air is then supplied to the modules 44–48. The air under pressure enters a typical chamber 62, passes through the apertures between each of the elements in the chambers 62 between the duct 54 and the porous member 30 so as to enter the porous member 30 under pressure. The heater 76 conductively heats plate 64. Plate 64 thermally conductively heats the porous member 30. This uniformly heats up the porous member 30 to the desired temperature. The air under pressure as it passes through the pores of the member 30 receives additional heat from member 30. The air then exits the pores in the direction of arrows 97 onto the film 12 heating the film 12 and developing the latent image thereon. Processor 20 preferably comprises three separate units such as illustrated in FIGS. 3 and 4 with four module pairs in each unit. The wall thickness between cavity 62 may be approximately 0.090 inches.

Porous members 30 and 34 preferably are spaced 0.006 inches apart with a 0.004 inch thick film. The pressure of the air supplied from blower 60 may be at 20–30 PSI. The pressure at the air gap 38 is approximately 5–7.5 PSI under these conditions. The temperature of the porous members 30 and 34 is preferably maintained at 210°–320° F.

The graphite preferably has a permeability of 0.5 times $10^{-11}$ square inches. Film 12 may be transported at any speed suitable to conditions. By varying the speed, different modules may be turned on and utilized for a given set of conditions.

The heat transfer plate 64 may in a particular example have a thickness of 1/32, inches, openings of 0.056 inches wide and strips 74 of 0.060 inches widths, the plate 64 having a length of 7 inches. Suitable heat conductive adhesive material may bond the heater 76 to the heat transfer plate 64. The heater 76 may be a wire encased in 3 mil thick outer coverings of thermoplastic material, such as Kapton, a trademark of the Dupont Corporation; formed of a polyimide material. By bonding the heater 76 directly to plate 64, the heater may readily be replaced should an occassional failure occur. This replacement is accomplished by merely removing the plate 64 and the heater 76 as an integral unit. Some prior art systems use electrical currents flowing through a porous member as a heating means for the member. This is not satisfactory for a film developing processor due to localized non-uniform heating that may occur.

While the heater 76 is shown slotted between strips 74 the heater 76 may also be formed with spaced relatively small apertures located between strips 74 to facilitate the assembly of the heater 76 to plate 64. In this form, the perforated heater may be handled as a single sheet. In this instance, the height or thickness of plate 64 provides a plenum cavity between the heater and the porous member for ensuring uniform gas pressure on the film side of the porous member.

Blower 60 has provisions (not shown) for adjusting the flow rate of ambient air supplied to ducts. The air is preheated by heaters 61 disposed in each of the ducts. Porous members 30 and 34 distribute air to both sides of the film 12, the air distribution being substantially uniform over the surface of the film 12 adjacent to porous members. Controlled air flow impinges upon the film 12 with uniform distribution and after striking the film, the exhausted air freely dissipates along the film 12.

Porous members 30 and 34 are positioned such that a relatively small spacing preferably in the order of 0.001–0.002 inches is between members 30 and 34 and film 12. For such a small spacing, the uniformly distributed air at the substantially uniform temperature heats film 12 by conduction more than by convection.

By providing direct conductive thermal heat transfer to the porous members 30 and 34 via plate 64, the temperature of the air exiting onto the film 12 is uniform throughout the apparatus. The porous members serve to integrate the temperature as well as provide uniform distribution of the air under pressure to the film 12.

Thermal processor 20 may be utilized in a film development system which utilizes heat processing for image development in which it does not require liquid developing agents. At present, black-and-white film is heat developed in a "dry" heat development process and may be used in the present invention. Color film is developed at present by "wet" processes which require the application of chemical agents for image fixation. It should be understood, however, that the present invention is not limited to the processing of black-and-white film but may be utilized with any photographic film coated with a photothermally sensitized emulsion and developed in the dry heat process.

What is claimed is:

1. A thermal processor for gas heat development of a photographic image on a strip of photographic film passing through the processor comprising:

a housing arranged to receive said gas under pressure, thermally conductive porous gas distribution means in fluid communication with said housing for uniformly distributing said gas to said film through the pores at a given pressure, said gas distribution means tending to have an irregular surface and being supported by said housing and being disposed adjacent opposite surfaces of said film at a spacing such that said pressure of gas at said film is sufficient to support said film when passing through said processor, and gas heating means including flexible heat generating means thermally conductively coupled to and juxtaposed with said irregular surface of said distribution means for uniformly heating said distribution means at an elevated temperature with respect to the ambient by thermal conduction regardless of the irregularities of said surface to thereby uniformly heat said gas as it passes through said pores.

2. The thermal processor as set forth in claim 1 wherein said housing includes a gas chamber, said generating means including heater element means disposed in said chamber, said element means having gas passages for passing said gas through said element means to said distribution means.

3. The thermal processor as set forth in claim 1 wherein said generating means includes an apertured thermally conductive flexible heat transfer means in thermal conductive contact with said gas distribution means and electrical heater means thermally conductively mounted on said heat transfer means for heating said gas distribution means through said heat transfer means.

4. The thermal processor as set forth in claim 3 wherein said generating means includes resilient pressure means disposed in said chamber for providing mechanical pressure to said heat transfer means for urging said heat transfer means in said thermally conductive contact with said gas distribution means.

5. The thermal processor as set forth in claim 1 further includes gas preheat means in fluid communication with said housing for heating said gas prior to said gas passing through said gas distribution means.

6. The thermal processor as set forth in claim 1 wherein said porous gas distributions means are porous materials selected from the group consisting of ceramic and graphite.

7. In a thermal processor, a gas heating apparatus comprising:

thermally conductive gas distribution means comprising a porous homogeneous material for uniformly distributing said gas through the pores of the material at a given pressure, and housing means supporting said gas distribution means arranged to receive said gas under prssure and supplying said pressurized gas to said distribution means, said gas distribution means including flexible gas heating means thermally conductivity and resiliently urged against said distribution means for uniformly directly heating and distribution means by thermal conduction to thereby uniformly heat said gas passing through the pores of said porous homogenous material.

8. The apparatus set forth in claim 7 wherein said heating means is mounted in said housing in the flow path of said gas supplied to said distribution means, said heater means including gas passage means arranged to pass said gas through said heater means to said gas distribution means for heating by said gas distribution means.

9. The apparatus as set forth in claim 8 wherein said heating means includes an apertured thermally conductive plate mounted in thermally conductive contact with said gas distribution means; and a heater element means thermally conductively mounted to said plate for heating said plate.

10. A thermal processor for gas heat development of a photographic image on a strip of photographic film passing through the processor comprising:

a housing arranged to receive said gas under pressure, said housing including a gas chamber, thermally conductive porous gas distribution means in fluid communication with said housing for uniformly distributing said gas to said film through the pores at a given pressure, said gas distribution means being supported by said housing and disposed adjacent opposite surfaces of said film at a spacing such that said pressure of gas at said film is sufficient to support said film when passing through said processor, and gas heating means thermally conductively coupled to said distribution means for heating said distribution means at an elevated temperature with respect to the ambient to thereby uniformly heat said gas as it passes through said pores, said gas heating means including heater element means disposed in said chamber, said element means having gas passages for passing said gas through said element means to said distribution means, said element means including an apertured thermally conductive flexible heat transfer means in thermal conductive contact with said gas distribution means and electrical heater means thermally conductively mounted on said heat transfer means for heating said gas distribution means through said heat transfer means, said heater element means further including resilient pressure means disposed in said chamber for providing mechanical pressure to said heat transfer means for urging said heat transfer means in said thermally conductive contact with said gas distribution means.

* * * * *

UNITED STATES PATENT AND TRADEMARK OFFICE
CERTIFICATE OF CORRECTION

PATENT NO. : 4,148,575

DATED : April 10, 1979

INVENTOR(S) : Bohdan W. Siryj

It is certified that error appears in the above-identified patent and that said Letters Patent is hereby corrected as shown below:

Column 6, line 63, "and" should be --said--.

Signed and Sealed this

*Thirty-first* Day of *July 1979*

[SEAL]

*Attest:*

*Attesting Officer*

LUTRELLE F. PARKER

*Acting Commissioner of Patents and Trademarks*